US006290327B1

(12) United States Patent
Hosokawa et al.

(10) Patent No.: US 6,290,327 B1
(45) **Date of Patent: *Sep. 18, 2001**

(54) IMAGE-FORMING DEVICE AND PRINTING APPARATUS INCORPORATING THE DEVICE AS WELL AS IMAGE-FORMING METHOD THEREFOR

(75) Inventors: Takeshi Hosokawa, Shiojiri; Kenji Watanabe, Tokyo; Tomoyuki Ichikawa, Tokyo; Kenichi Tanabe, Tokyo; Rie Sudo, Tokyo, all of (JP)

(73) Assignees: Seiko Epson Corporation; Kin Jim Co., Ltd., both of Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/275,705

(22) Filed: Mar. 25, 1999

(30) Foreign Application Priority Data

Mar. 27, 1998 (JP) ..... 10-100211

(51) Int. Cl.[7] ..... B41J 2/15
(52) U.S. Cl. ..... 347/41; 347/5; 358/1.11
(58) Field of Search ..... 347/41, 5; 400/63, 400/83, 621, 121, 210, 304; 197/1 R, 53; 358/1.2, 1.11

(56) References Cited

U.S. PATENT DOCUMENTS 4,050,563 * 9/1977 Menhennett ..... 197/1 R
4,942,390 * 7/1990 Do et al. ..... 340/735
5,205,660 * 4/1993 Momose ..... 400/304
5,447,383 * 9/1995 Hirono et al. ..... 400/621
5,519,824 * 5/1996 Lizzi ..... 395/150
5,540,507 * 7/1996 Niwa et al. ..... 400/83
5,549,399 * 8/1996 Sakuragi et al. ..... 400/63

FOREIGN PATENT DOCUMENTS 05-096790 4/1993 (JP) .

* cited by examiner

*Primary Examiner*—N. Le
*Assistant Examiner*—Lamson D. Nguyen
(74) *Attorney, Agent, or Firm*—Hogan & Hartson, L.L.P.

(57) ABSTRACT

There are provided an image-forming device and method for varying an elongation rate of a basic image in at least one of a direction of length of the basic image and a direction of width of the basic image based on a specific elongation pattern to thereby form a deformed image from the basic image, as well as a printing apparatus incorporating the image-forming device. Elongation data of the elongation pattern is stored. Basic image data representative of the basic image is developed into a dot matrix. Each dot line of the basic image data extending in at least one of directions corresponding respectively to the direction of length of the basic image and the direction of width of the basic image is duplicated based on the elongation data. A dot line generated by duplication of the each dot line is added between the each dot line and a following dot line adjacent to the each dot line.

14 Claims, 14 Drawing Sheets

FIG. 8B

| STEP | INSTRUCTION |
|---|---|
| S11 | GENERATE NORMAL PRINT DATA |
| S12 | INITIALIZE LINE NUMBER COUNTER, ONE-LINE DUPLICATION COUNTER, PRINT DATA R/W POINTER |
| S13 | NUMBER OF TIMES OF ONE-LINE DUPLICATION = 1 |
| S14 | WITHIN EL PRINT AREA ? |
| S15 | CALCULATE NUMBER OF TIMES OF ONE-LINE DUPLICATION |
| S16 | WRITE DOT LINE TO BE DUPLICATED |
| S17 | INCREMENT ONE-LINE DUPLICATION COUNTER BY 1 |
| S18 | CALCULATED NUMBER OF TIMES OF ONE-LINE DUPLICATION = COUNT OF ONE-LINE DUPLICATION COUNTER ? |
| S19 | CLEAR COUNT OF ONE-LINE DUPLICATION COUNTER |
| S20 | UPDATE LINE NUMBER COUNTER, PRINT DATA R/W POINTER |
| S21 | WRITING COMPLETED ? |

NUMBERS OF TIMES OF DUPLICATION 1 1 2 2 3 3

FIG. 11B

| STEP | INSTRUCTION |
|---|---|
| S31 | GENERATE NORMAL PRINT DATA |
| S32 | INITIALIZE LINE NUMBER COUNTER,<br>ONE-LINE REPETITION COUNTER,<br>PRINT DATA R POINTER |
| S33 | NUMBER OF TIMES OF ONE-LINE REPETITION = 1 |
| S34 | WITHIN EL PRINT AREA ? |
| S35 | CALCULATE NUMBER OF TIMES OF ONE-LINE REPETITION PRINTING |
| S36 | PRINT DOT LINE TO BE PRINTED |
| S37 | INCREMENT ONE-LINE DUPLICATION COUNTER BY 1 |
| S38 | CALCULATED NUMBER OF TIMES OF ONE LINE REPETITION PRINTING =<br>COUNT OF ONE-LINE REPETITION COUNTER ? |
| S39 | CLEAR COUNT OF ONE-LINE REPETITION COUNTER |
| S40 | UPDATE LINE NUMBER COUNTER, PRINT DATA R POINTER |
| S41 | PRINTING COMPLETED |

FIG. 12A
PRIOR ART

PRINT

FIG. 12B
PRIOR ART

PRINT

IMAGE-FORMING DEVICE AND PRINTING APPARATUS INCORPORATING THE DEVICE AS WELL AS IMAGE-FORMING METHOD THEREFOR

BACKGROUND OF THE INVENTION

1. Field of the Invention

This invention relates to an image-forming device for elongating an image in a predetermined direction, which is employed in an electronic apparatus, such as a tape printer and a word processor, and a printing apparatus incorporating the device as well as an image-forming method therefor.

2. Prior Art

Conventionally, to obtain an expressive printed image, rich in variety, of entered characters including letters and symbols, an electronic apparatus having the printing capability, such as a word processor, is capable of forming an image generally increased or reduced in size by employing various character sizes, or forming an image generally elongated or shorted in a horizontal direction (in a left-right direction) or in a vertical direction(in a top-bottom direction).

The conventional electronic apparatus, which is capable of expanding or contracting, or elongating or shortening an image as a whole, however, is not capable of forming e.g. an image partially elongated. More specifically, it is impossible to form an image of one character (one character image), which has a left half portion having a normal or original size and a right half portion having an elongated size.

Of course, from an image (character string image) of a plurality of characters shown in FIG. 12A, it is possible to form a partially elongated image as shown in FIG. 12B. However, this image is merely formed by changing the whole size of a character image of each selected character, but not formed by changing part of the character image. What is more, to form such a modified character string image, the user is required to set a rate of elongation for each character image, and the operation of the apparatus becomes very troublesome. Further, this character string image is formed by stepwise varying the rate of elongation, on a character by character basis, and it has been impossible to form character string images by continuously changing the elongation rate (see FIGS. 5A to 5E).

SUMMARY OF THE INVENTION

It is an object of the invention to provide an image-forming device which is capable of partially elongating an image in a predetermined direction, thereby forming an image richer in variety than the prior art, and a printing apparatus incorporating the device, as well an image-forming method there for.

To attain the object, according to a first aspect of the invention, there is provided an image-forming device for varying an elongation rate of a basic image in at least one of a direction of length of the basic image and a direction of width of the basic image based on a specific elongation pattern to thereby form a deformed image from the basic image.

The image-forming device is characterized by comprising:

elongation pattern storage means for storing elongation data of at least the specific elongation pattern;

data-developing means for developing basic image data representative of the basic image into a dot matrix;

duplicating means for duplicating each dot line of the basic image data extending in at least one of directions corresponding respectively to the direction of length of the basic image and the direction of width of the basic image, based on the elongation data; and addition means for adding a dot line generated by duplication of the each dot line by the duplicating means between the each dot line and a following dot line adjacent to the each dot line.

According to this image-forming device, each dot line of the basic image data extending in at least one of directions corresponding respectively to the direction of length of the image and the direction of width of the image is duplicated based on the elongation data, and a dot line generated by duplication of the each dot line by the duplicating means is added between the each dot line and a following dot line adjacent to the each dot line.

It should be noted that the basic image not only includes various kinds of images, such as a character string image comprising an image of at least one character, such as letters and symbols, (including a character string image decorated e.g. by various kinds of character decoration), but also a kind of non-character string image comprising an image of a figure or a picture, an image comprising a combination of a non-character string image and a character string image. Further, the elongation rate is a proportion of the length of an elongated portion to the length of its original portion. The elongation data includes not only the number of duplications of each dot line but also an equation for calculating the number of duplications.

Preferably, the elongation data stored in the elongation pattern storage means comprises elongation data of a plurality of elongation patterns, the image-forming device including elongation pattern-selecting means for selecting the specific elongation pattern from the plurality of elongation patterns.

According to this preferred embodiment, the user can select a desired elongation pattern from the plurality of elongation patterns, which enables him to create an image with much freedom of deformation.

Preferably, the basic image comprises at least one character image, and the plurality of elongation patterns include an elongation pattern for varying the elongation rate of the basic image in units of length smaller than a horizontal width of one character image in the basic image or in units of length smaller than a vertical width of the one character image in the basic image.

According to this preferred embodiment, the elongation rate can be varied in units of length or width shorter than a horizontal or vertical width of one character, and hence it is possible to form an image containing character images which are partially elongated from those in the basic image.

Preferably, the plurality of elongation patterns include one for varying the elongation rate of the basic image in a continuous manner.

According to this preferred embodiment, the basic image is elongated in a predetermined direction at a continuously changing elongation rate. This makes it possible to obtain a deformed image in which the basic is elongated without causing a feeling of strangeness.

Preferably, the elongation data includes data of a maximum number of times of duplication permitted to be carried for the each dot line, the maximum number being dependent on a size of an image area in which the deformed image is to be formed.

According to this preferred embodiment, the maximum number of times of duplication permitted to be carried for the each dot line can be determined in dependence on the size of an image area in which the deformed image is to be formed. Therefore, it is possible to form an image suitable for the image area.

Preferably, the elongation data includes an equation for calculating a number of times of duplication to be carried out for the each dot line, and the data-developing means comprises a temporary storage buffer for loading the basic image data therein, the duplication means comprising a line number counter for counting a number of the each dot line of the basic image data, a duplication counter for counting a number of times of the duplication, a print data read pointer for designating an address of the temporary storage buffer from which the each dot line is read out, a print buffer into which the each dot line read out from the temporary storage buffer is written, and a print data write pointer for designating an address of the print buffer at which the each dot line read from the temporary storage buffer is written.

Alternatively, the elongation data includes an equation for calculating a number of times of duplication to be carried out for the each dot line, and the data-developing means comprises a buffer for loading the basic image data therein, the duplication means comprising a line number counter for counting a number of the each dot line of the basic image data, a one-line repetition counter for counting a number of times of repetition of reading of the each dot line from the buffer, and a print data read pointer for designating an address of the buffer from which the each dot line is read out.

To attain the above object, according to a second aspect of the invention, there is provided a printing apparatus comprising:

an image-forming device for varying an elongation rate of a basic image in at least one of a direction of length of the basic image and a direction of width of the basic image based on a specific elongation pattern to thereby form a deformed image from the basic image, the image-forming device comprising:

elongation pattern storage means for storing elongation data of at least the specific elongation pattern;

data-developing means for developing basic image data representative of the basic image into a dot matrix;

duplicating means for duplicating each dot line of the basic image data extending in at least one of directions corresponding respectively to the direction of length of the basic image and the direction of width of the basic image, based on the elongation data; and addition means for adding a dot line generated by duplication of the each dot line by the duplicating means between the each dot line and a following dot line adjacent to the each dot line; and printing means for printing the deformed image formed by the image-forming device.

According to this printing apparatus, it is possible to print an image elongated by the image-forming device on a print medium, such a print paper or a tape.

To attain the above object, according to a third aspect of the invention, there is provided a method of forming an image, wherein an elongation rate of a basic image is varied in at least one of a direction of length of the basic image and a direction of width of the basic image based on a specific elongation pattern to thereby form a deformed image from the basic image.

The method according to the third aspect of the invention is characterized by comprising the steps of:

developing basic image data representative of the basic image into a dot matrix;

duplicating each dot line of the basic image data extending in at least one of directions corresponding respectively to the direction of length of the basic image and the direction of width of the basic image, based on elongation data of at least the specific elongation pattern; and adding a dot line generated by duplication of the each dot line between the each dot line and a following dot line adjacent to the each dot line.

According to this method, it is possible to obtain the same advantageous effects obtained by the image-forming device according to the first aspect of the invention.

The above and other objects, features, and advantages of the invention will become more apparent from the following detailed description taken in conjunction with the accompanying drawings.

BRIEF DESCRIPTION OF THE DRAWINGS

FIGS. 8A and 8B form a flowchart showing a routine for internal processing executed in special printing;

FIGS. 11A and 11B form a flowchart showing a routine for internal processing executed in special printing; and FIGS. 12A and 12B are diagrams showing print images formed e.g. by a conventional word processor.

DETAILED DESCRIPTION

The invention will now be described in detail with reference to the drawings showing an embodiment thereof. A tape printing apparatus to which are applied an image-forming device and a printing apparatus incorporating the device as well an image-forming method therefor, according to the embodiment, is a thermal transfer type that carries out printing of desired characters and the like entered via a keyboard thereof on a tape by a thermal transfer printing method and then cuts off the printed portion of the tape to thereby make a label.

Figure 1:
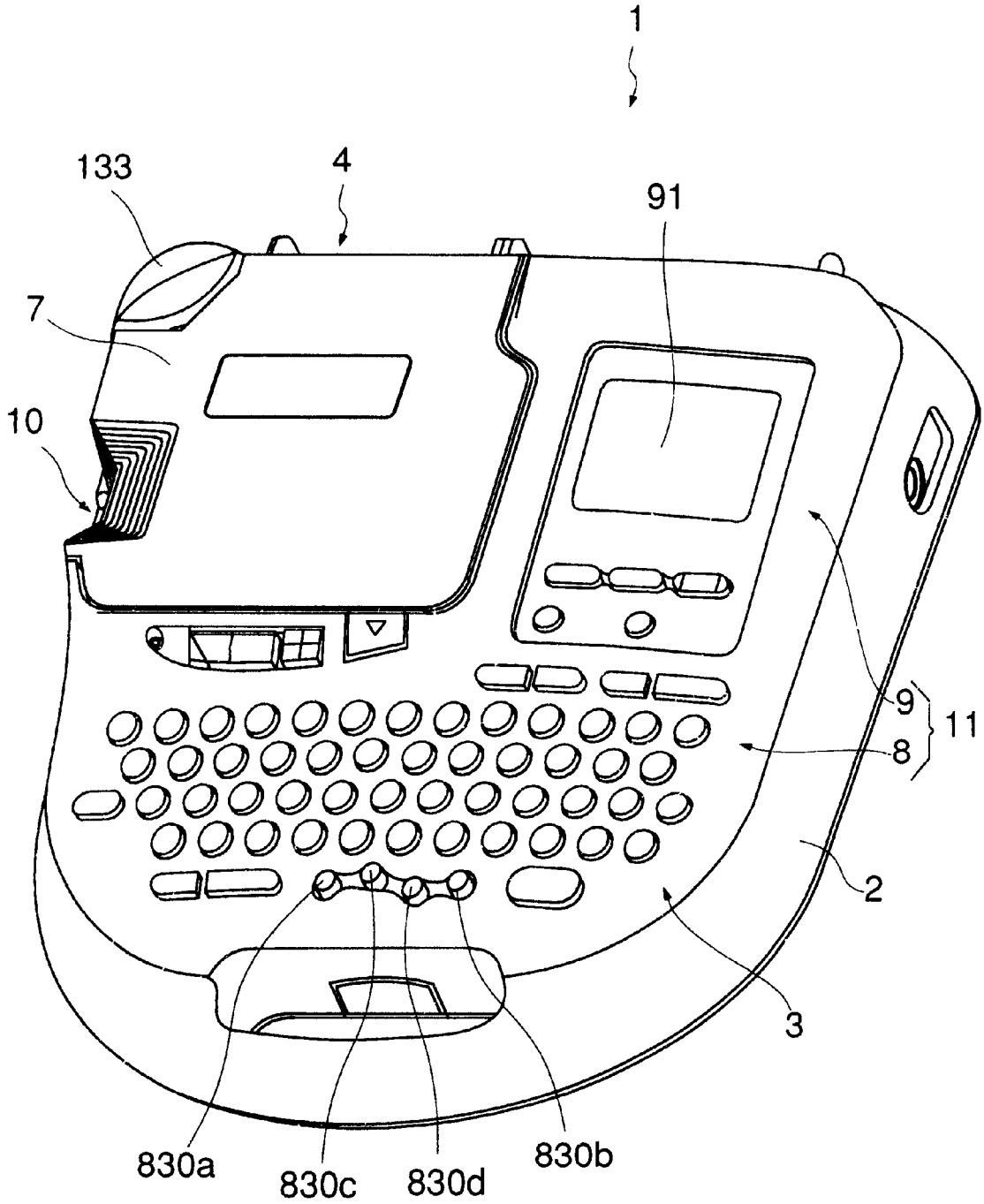
FIG. 1 is a perspective view showing an appearance of a tape printing apparatus to which are applied an image-forming device, a printing apparatus incorporating the printer, as well as a method of forming an image, according to an embodiment of the invention.
Figure 2:
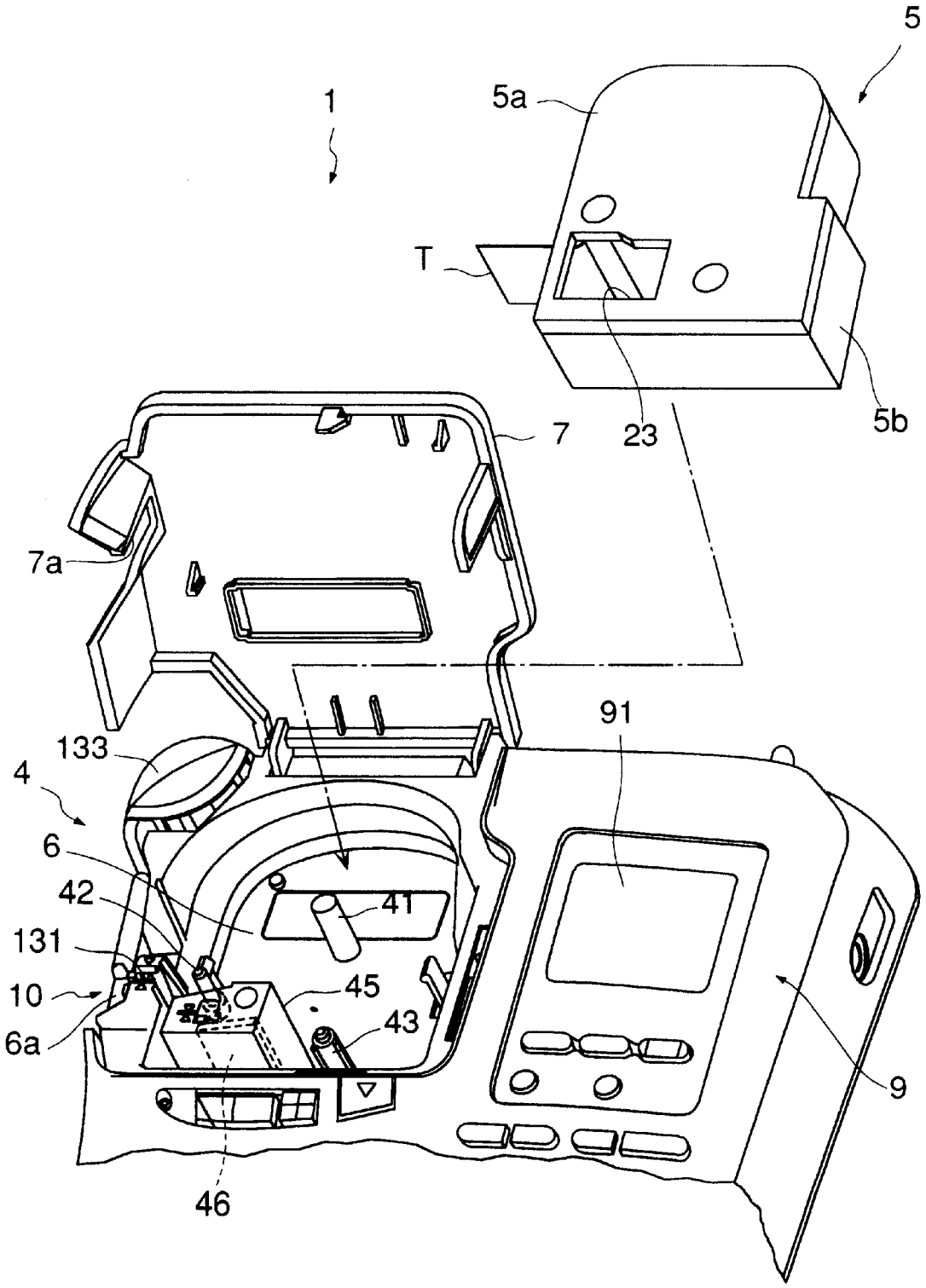
FIG. 2 is a perspective view showing a compartment of the FIG. 1 tape printing apparatus and component parts associated with the compartment.

Referring first to FIG. 1, the tape printing apparatus 1 includes a casing 2 having upper and lower divisional portions, an electronic block 3 arranged in the form of an inverted L-shape from a front half portion of the apparatus 1 to a rear right half portion of the same, and a mechanical block 4 arranged in a rear left half portion of the apparatus 1. As shown in FIG. 2, the mechanical block 4 is comprised of a compartment 6 for receiving therein a tape cartridge 5 and a lid 7 for opening and closing the compartment 6, which is formed with a window. The lid 7 has a left side wall thereof formed with an inverted U-shaped opening 7*a*, while the compartment 6 has a left side wall thereof formed with a U-shaped opening 6*a*. The two openings 6*a* and 7*a* form a tape exit 10 through which a printed tape T is sent out of the tape printing apparatus 1.

Figure 4:
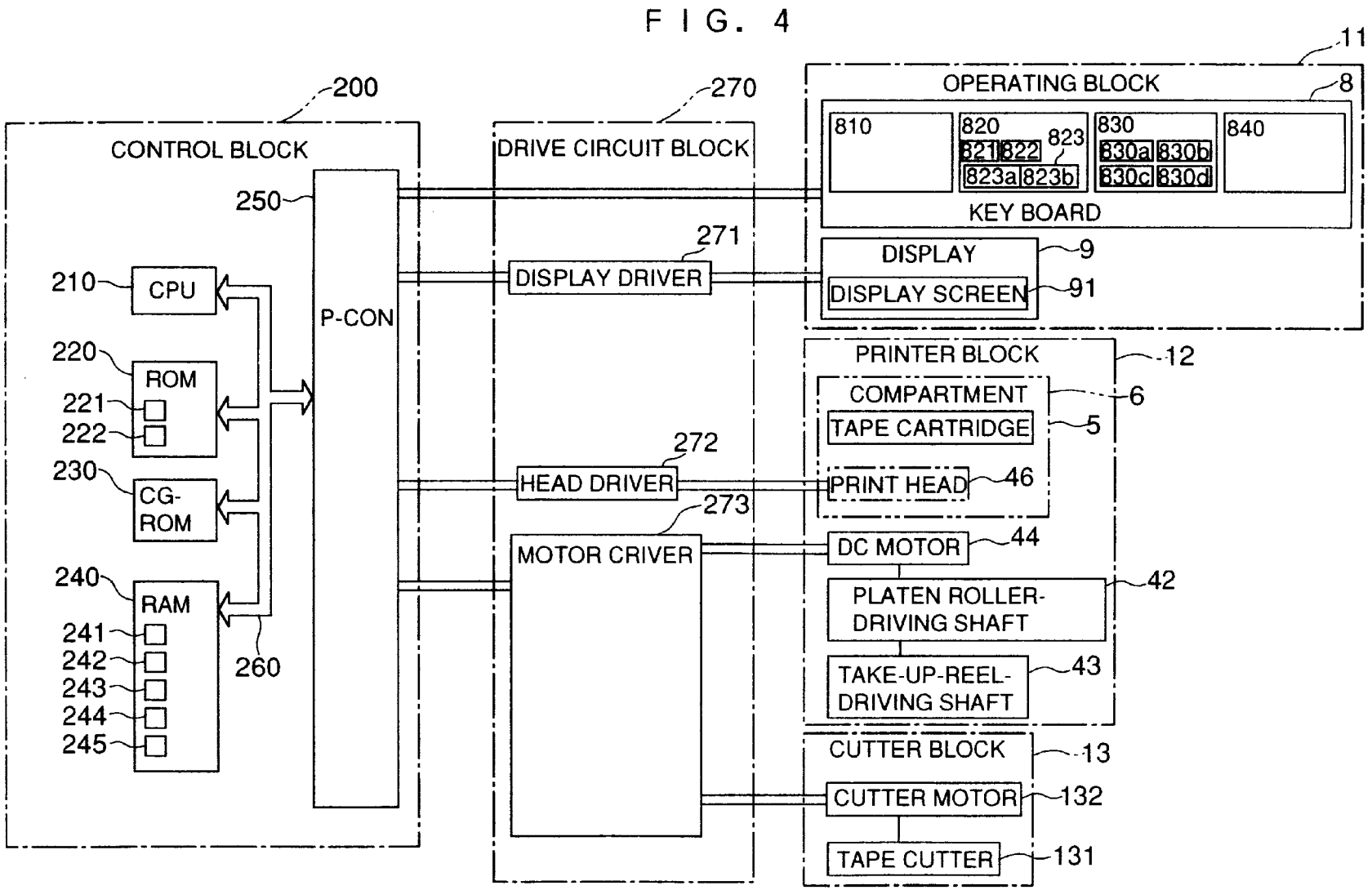
FIG. 4 is a block diagram schematically showing a control system of the FIG. 1 tape printing apparatus.

The electronic block 3 has an operating block 11 formed on a top thereof and includes a control block 200, referred to hereinbelow (see FIG. 4). The operating block 21 includes a key board 8 connected to a peripheral control circuit (P-CON) 250 of the control block 200, and a display 9 connected to the P-CON 250 via a display driver 271 of a driving circuit 270, referred to hereinafter.

On the keyboard 8, there are arranged a character key group 810 including a lot of keys 810 for use in entering characters such as letters, symbols and simple figures and a function key group 820 for use in giving instructions for editing, printing, etc. of the entered characters. The function key group 820 includes cursor keys 830 (left arrow key 830*a*, right arrow key 830*b*, up arrow key 830*c*, and down arrow key 830*d*) for moving a cursor on the display 9, a selection key 840 for selecting a desired one out of a plurality of options, and so forth. The display 9 has a rectangular display screen 91 on which are displayed images of entered characters as well as various operational modes and options to be selected during editing and printing of the images.

Next, description will be made of a printing block 12 which carries out printing on the tape T of the tape cartridge 5. The tape cartridge 5 is constructed such that it is removable from the mechanical block 4, and it is replaceable together with a casing thereof when the ink ribbon C is used up. Further, as the tape cartridge 5, there are supplied various types which contain tapes T different in width or color.

Figure 3:
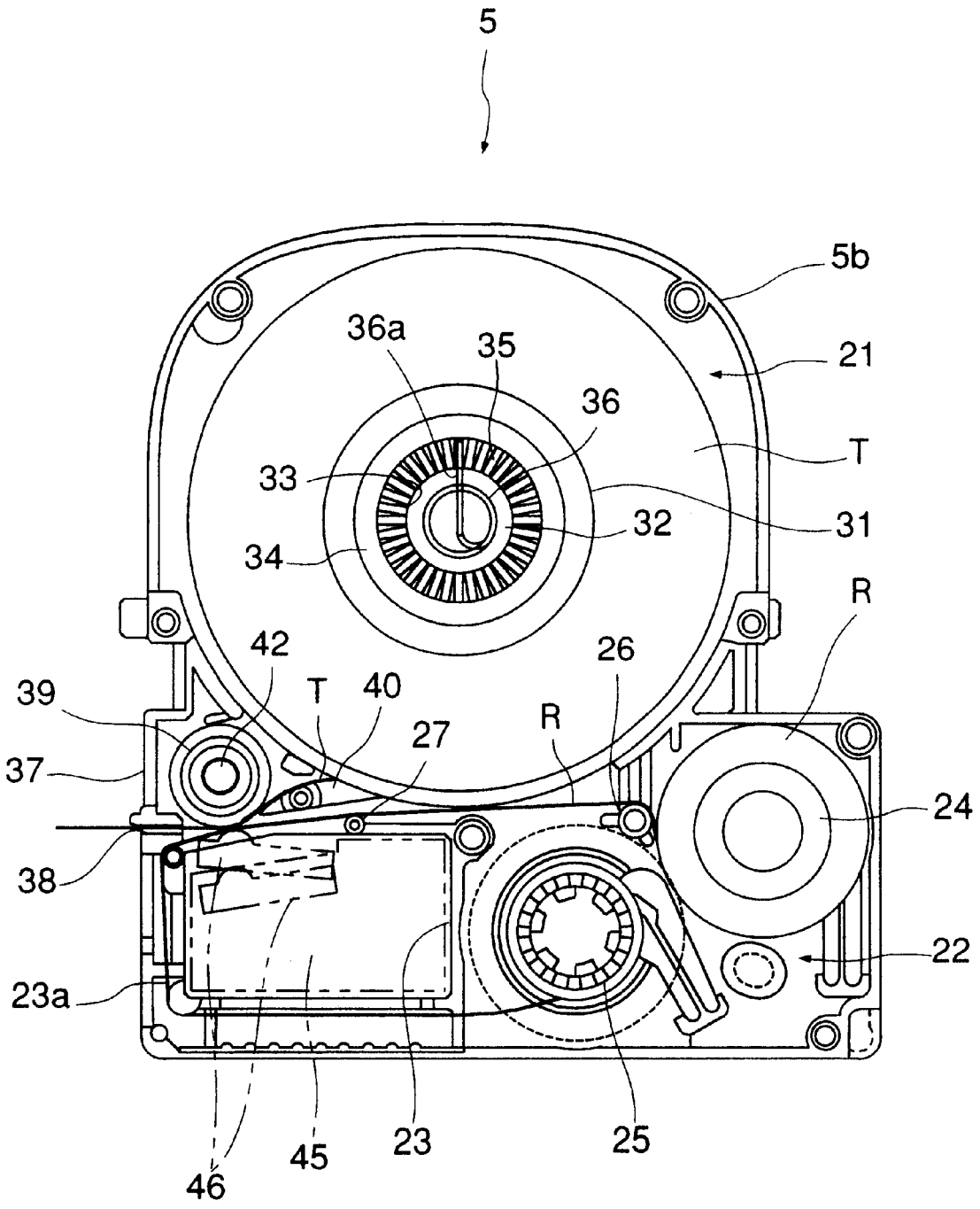
FIG. 3 is a plan view of an internal construction of a tape cartridge.

FIG. 3 shows the tape cartridge 5 from which an upper casing thereof is removed. The tape cartridge 5 has a casing comprised of the upper casing 5*a* (see FIG. 2) and a lower casing 5*b*. The inside of the casing is divided into a tape-holding block 21 for holding the tape T therein and an ink ribbon-holding block 22 for holding an ink ribbon R therein. The ink ribbon-holding block 22 is formed with a rectangular head opening 23 through which a head unit 45 having a print head 46, described hereinafter, is fitted in when the tape cartridge 5 is mounted in the compartment 6.

The ink ribbon-holding block 22 contains a ribbon supply reel 24 around which the ink ribbon R is wound, and a ribbon take-up reel 25 for taking up used part of the ink ribbon R therearound, each arranged in a rotatable manner. The ink ribbon R rolled out from the ribbon supply reel 24 is guided by a first guide pin 26 and a second guide pin 27 to a platen roller 39, referred to hereinafter, and then makes a U-turn in a manner traveling along a peripheral wall 23*a* of the head opening 23 to be taken up by the ribbon take-up reel 25.

The tape-holding block 21 formed to have a generally circular shape has a cylindrical reel support portion 32 formed at a central portion thereof in the lower casing 5*b* in a protruding manner, for rotatably supporting a tape reel 31 around which the tape T is wound. The tape reel 31 has a cylindrical shape, and a rib 34 having a through hole 33 extending therethrough is formed on an inner peripheral wall of the tape reel 31 at a central portion along the thickness of the reel 31. The rim of the rib 34 surrounding the through hole 33 is formed with numerous projections 35 continuously arranged to form a generally annular shape.

The tape reel 32 constructed as above is loosely fitted over the reel support portion 32 having a coiled spring 36 fitted therein from above. The coiled spring 36 has one end (upper end) thereof abutting an inner surface of the upper casing 5*a* and another end (lower end) 36*a* thereof bent in a manner crossing the reel support 32. An extreme end of the lower end 36*a* reaches into the projections 35 of the rib 34 through a cutaway portion formed in an upper end of the support portion 32. When the tape cartridge 5 is not mounted in the apparatus body, the extreme end of the lower end 36*a* of the coiled spring 36 is caught between the projections 35. 35. This engagement of the lower end 36*a* of the coiled spring 36 with the projections 35 prohibits the tape reel 31 from moving, thereby preventing the tape T from sagging due to rotation of the tape reel 31 when the tape cartridge is not loaded in the apparatus body.

At an end of a boundary between the tape-holding block 21 and the ink ribbon-holding block 22 in a side wall of a casing 37, there is formed a tape exit 38 in the form of a slit through which the tape T is sent out of the tape-holding block 21. Further, the platen roller 39 is rotatably arranged at the vicinity of the tape exit 38 in a downstream portion of the tape-holding block 21, where the tape T and the ink ribbon R are placed one upon the other and printing is carried out by pressing the print head 46 against the ink ribbon R. At a location remote from the tape exit 38 with respect to the platen roller 39 is formed a curved guide portion 40 via which the tape T is guided to the platen roller 39 for sliding contact therewith and sent out through the tape exit 38.

On the other hand, in the compartment 6 for receiving the tape cartridge 5, there is formed a positioning pin 41 projecting upward as shown in FIG. 2. The positioning pin 41 is fitted into the reel support portion 32 of the lower casing 5*b* from below to thereby facilitate proper mounting of tape cartridge 5 in the compartment 6. When the tape cartridge 5 is loaded in the compartment 6, an upper end of the positioning pin 41 urges the lower end 36*a* of the coiled spring 36 upward, whereby the lower end 36*a* is disengaged from the projections 35 of the rib 34 to permit free rotation of the tape reel 31 for smooth feeding of the tape T.

Further, in the compartment 6, there are provided a platen roller-driving shaft 42 and a ribbon take-up reel-driving shaft 43 in a manner extending perpendicularly from the bottom of the compartment 6. The platen roller-driving shaft 42 engages with the platen roller 39 to drive the same for rotation, while the ribbon take-up reel-driving shaft 43 engages with the ribbon take-up reel 25 to drive the same for rotation. The platen roller-driving shaft 42 and the ribbon take-up reel-driving shaft 43 are operated by a DC motor 44 (see FIG. 4) via a reduction gear train, not shown. During printing, the shafts 42 and 43 each rotate by a predetermined amount to feed the tape T and the ink ribbon R by a corresponding predetermined amount, respectively.

As shown in FIG. 2, the head unit 45 accommodates the print head 46 comprised of a thermal head. The print head 46 can move between an original or waiting position thereof and a printing position in which it presses the tape T and the ink ribbon R against the platen roller 39. More specifically, the print head 46 is held in the original or waiting position when printing is not carried out, and is moved to the printing position in response to a print command to effect a predetermined print on the tape T based on print data supplied to the print head 46 via the P-CON 250 and a head driver 272.

Next, a cutting block 13 for cutting off the printed portion of the tape T will be described. The cutting block 13 includes a tape cutter 131 provided on a compartment side of the tape exit 10 for cutting the tape T and a cutter motor 132 for driving the tape cutter 131 for a cutting operation. When a printing process is terminated, the tape T is further fed by a predetermined amount, and then stopped, whereupon the cutter motor 132 starts driving the tape cutter 131 for cutting off the printed portion of the tape T automatically (automatic cutting). In the tape printing apparatus 1, it is also possible to cancel an automatic cutting mode and cut the tape T manually. In this case, when the tape T is sent out by a predetermined amount after completion of printing, a cutting button 133 arranged in a rear left corner of the tape printing apparatus 1 is depressed so as to drive the tape cutter 131 for cutting operation (manual cutting).

Next, a basic construction of a control system of the tape printing apparatus 1 will be described with reference to FIG. 4. As shown in the figure, in the tape printing apparatus 1, the control block 200 controls the display 9, the printing block 12, and the cutting block 13, via the driving circuit 270 in response to input signals from the keyboard 8. The control block 200 includes a CPU 210, a ROM 220, a character generator ROM (CG-ROM) 230, a RAM 240 and the P-CON 250, all of which are connected to each other by a bus 260.

The ROM 220 includes a control program memory area 221 storing control programs executed by the CPU 210, a control data memory area 222 storing various control data items, and so forth. The CG-ROM 230 stores font data of characters, such as letters, symbols and graphics, provided for the tape printing apparatus 1, and outputs corresponding font data when code data identifying a character is given thereto.

The RAM 240 is used as a work area for carrying out control processes. The RAM 240 includes a register group 241, a text data memory area 242 for storing text data entered by the user via the keyboard 8, a display image data memory area 243 for storing image data corresponding to contents displayed on the display screen 91, a print buffer 244 which is an area for forming an image to be printed on the tape T (i.e. a print image), and a temporary storage buffer 245 which is an area for temporarily storing data therein. The RAM 240 is supplied with power by a backup circuit, not shown, even when the power is turned off, so as to keep stored data therein.

The P-CON 250 includes a logical circuit comprised of a gate array, a custom LSI, etc. for complementing the function of the CPU 210 as well as dealing with signals for interface with peripheral circuits. The P-CON 250 is connected to the keyboard 8 and various sensors, not shown, for delivering various commands and input data from the keyboard 8 and various detection signals from the sensors to the CPU 210 or the RAM 240 via the bus 260, after processing or without any processing. The P-CON 250 also delivers data and control signals received from the CPU 210, etc. via the bus 260, to the driving circuit 270 after processing or without any processing.

The driving circuit 270 is comprised of the display driver 271, the head driver 272, and a motor driver 273. The display driver 271 controls the display screen 91 in response to control signals outputted from the control block 200. Similarly, the head driver 272 drives the print head 46 in accordance with instructions from the control block 200. Further, the motor driver 273 drives the DC motor 44 of the print block 12 to control the platen roller-driving shaft 42 and the take-up reel-driving shaft 43 and at the same time drives the cutter motor 132 of the cutting block 13 to control the tape cutter 131.

In the control system configured as above, the CPU 210 receives via the P-CON 250 various commands and data items entered via the keyboard 8 in accordance with control programs read out from the ROM 220, processes font data from the CG-ROM 230 and various data items stored in the RAM 240, and delivers control signals to the driving circuit 270 via the P-CON 250 to thereby carry out print control and display control of the display screen 91, and at the same time control the print head 46 to cause the same to carry out printing on the tape T under predetermined printing conditions. In short, the CPU 210 controls the overall operation of the tape printing apparatus 1.

In the case of the tape printing apparatus 1, the image-forming device and the printing apparatus incorporating the device as well as the method of forming an image according to the invention are implemented mainly by the operating block 11 and the control block 200. Now, features of operations executed by the tape printing apparatus 1 will be described with reference to FIGS. 5A to 11, following operating procedures up to the label making.

First, when the power is turned on, the tape printing apparatus 1 is started to be placed in an operating status (operational mode) in which key entry is permitted, i.e. in an entry mode. In this entry mode, the keyboard 8 can be operated as required to enter desired characters (hereinafter referred to as "a character string" (including a case in which the character string is formed of a single character)). The printing apparatus 1 is capable of not only printing an image of an entered character string (character string image) on the tape T just as it is, but also decorating part or the whole of the character string image e.g. by the technique of "italicization", "emphasis", "hollow characters" or the like and then printing the decorated character string on the tape T. To carry out decoration of a character string, a decoration mode key 821 for changing modes is depressed to switch the operational mode from the entry mode to a decoration mode. Then, when a desired decoration is displayed by operating the cursor keys 830 (left arrow key 830*a*, right arrow key 830*b*, up arrow key 830*c*, and down arrow key 830*d*) as required, the selection key 840 is depressed to finally determine the decoration.

Printing is carried out by depressing a print key 823 when entry of a character string is completed, or after completion of setting of a decoration or an outer frame if it is desired. The tape printing apparatus 1 is provided with two kinds of print keys 820. One of them is a normal print key 823*a* for printing an entered character string on the tape T as it is (or in a decorated state e.g. if the decoration of the character string is set), and the other is a special print key 823*b* for printing a character string in a manner such that it is undulated or serrated in the direction of width of the tape T. Hereinafter, printing carried out by depressing the normal print key 823*a* is referred to as "normal printing", while printing carried out by depressing the special print key 823*b* is referred to as "special printing".

Next, description will be made of a method of printing a character string image of an entered character string on the tape T, particularly in special printing.

Now, let it be assumed that a character string "ELONGATED PRINT" is entered in the tape printing apparatus 1.

Figures 5A, 5B, 5C, 5D, 5E:
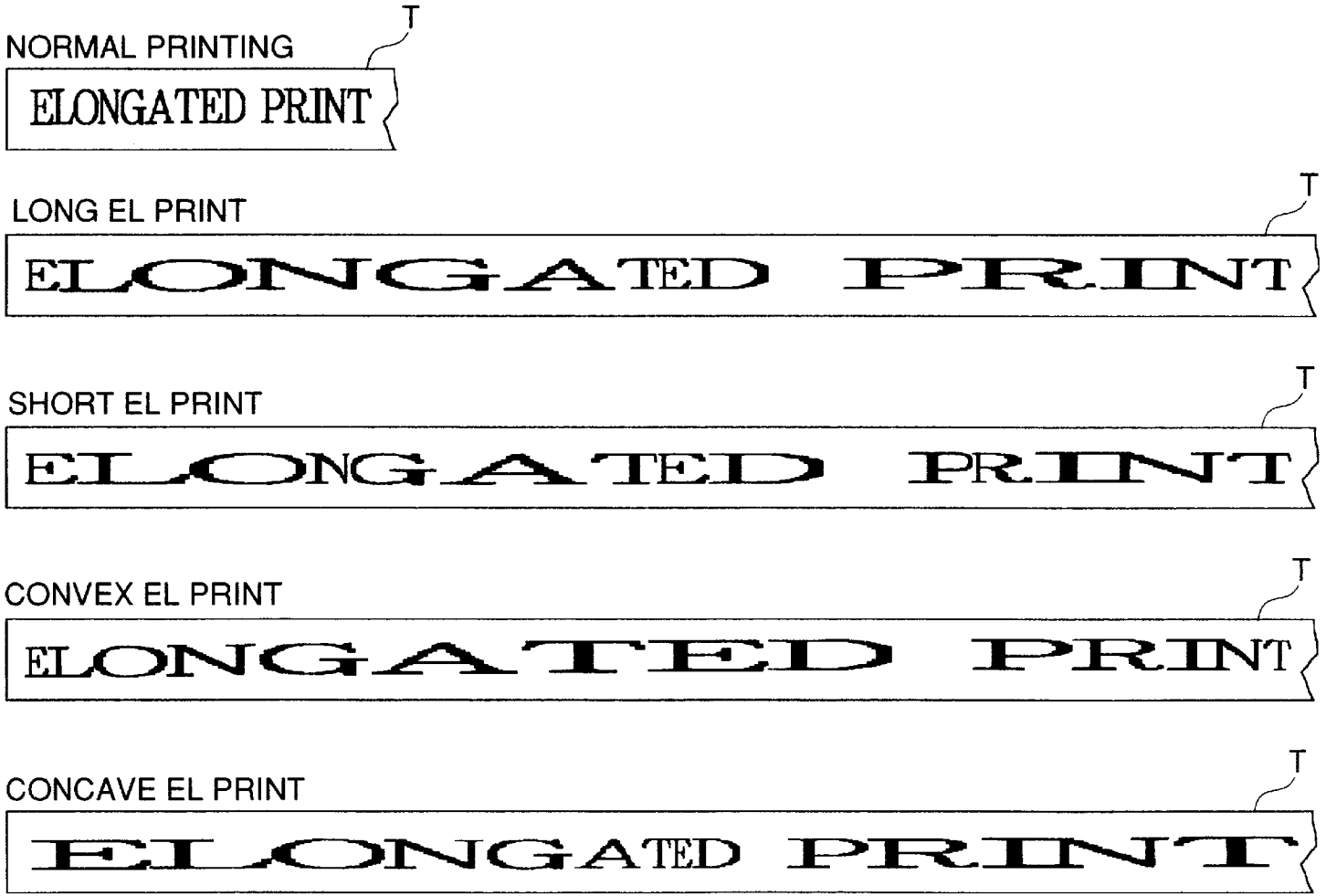
FIG. 5A shows an image printed in normal printing.
FIGS. 5B to 5E show images printed in special printing.

If the character string is entered and then the normal print key 823*a* is depressed for carrying out printing (normal printing), without a decoration of the character string being set, an image of the character string "ELONGATED PRINT" is printed on the tape T as shown in FIG. 5A. On the other hand, after entry of the same character string, if the special print key 823*b* is depressed for carrying out printing (special printing), the character string image is printed in a manner elongated along the length of the tape (deformed image) as shown in FIGS. 5B to 5E.

In the following, printing in which a character string image is printed in an elongated manner is referred to as "elongated printing", which is abbreviated to "EL print" when considered proper. Further, as shown in FIGS. 5B and 5C, out of types of EL print in which the elongation of the character string is repeated several times, one in which the elongation rate is gently varied is referred to as "long EL print" (FIG. 5B) while the other in which the elongation rate is varied more steeply than "long EL print" is referred to as "short EL print" (FIG. 5C). Further, as shown in FIGS. 5D and 5E, a type in which the elongation rate is larger at an inner portion of the character string than at opposite end portions is referred to as "convex EL print" (FIG. 5D) and, inversely, a type in which the elongation rate is smaller at an inner portion of the character string than at opposite end portions is referred to as "concave EL print" (FIG. 5E).

Figure 6:
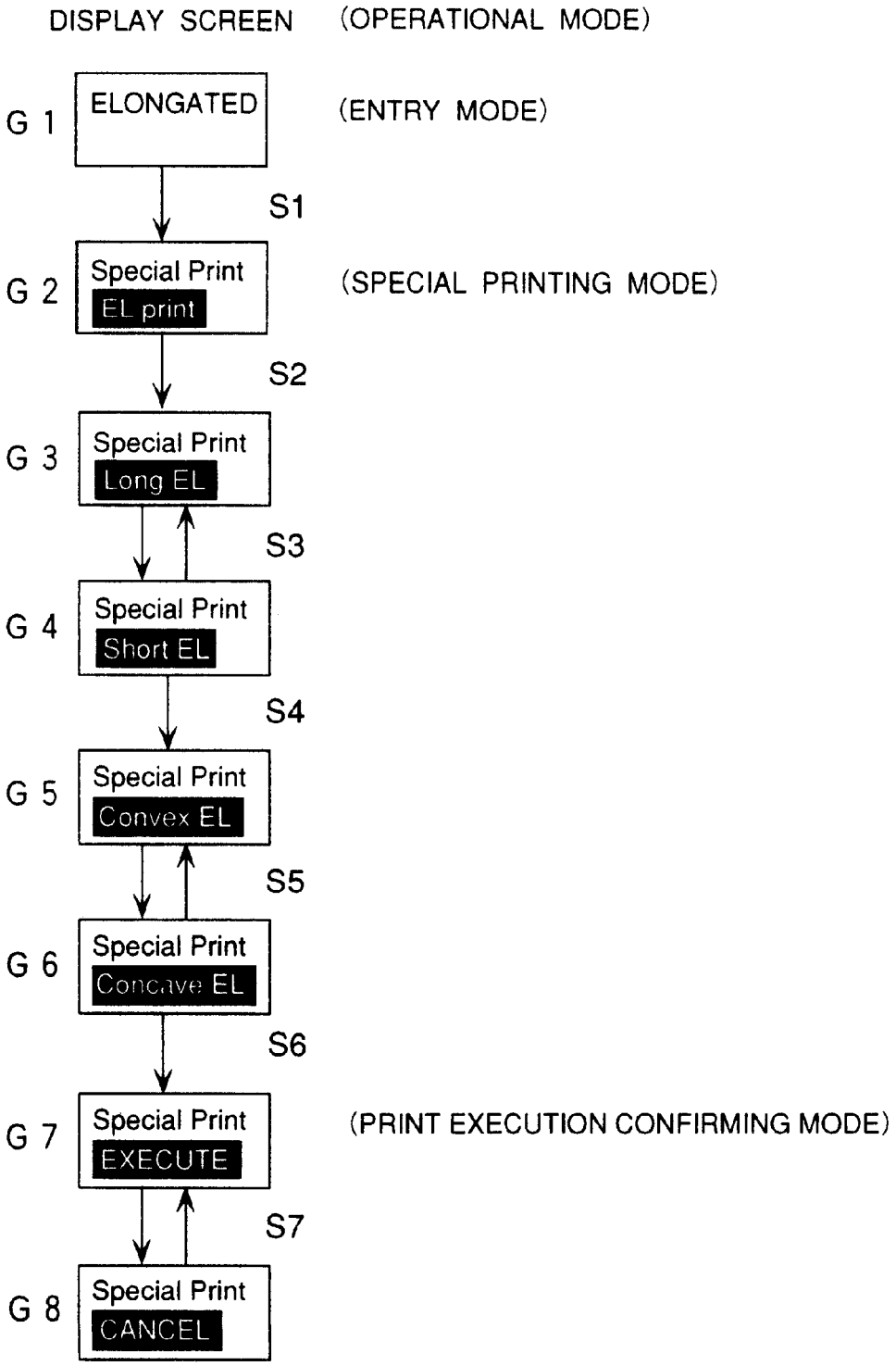
FIG. 6 is a diagram which is useful in explaining operations of a keyboard for special printing and changes in screen display corresponding to the operations.

FIG. 6 is for explaining keyboard operations in special printing and shows changes in the screen display caused by the keyboard operations. In the figures, G1 to G8 each schematically show an image of a screen displayed on the display screen 91, while S1 to S8 each represent a keyboard operation described hereinbelow. As shown in FIG. 6, when the special print key 823*b* is depressed (S1) after the character string is entered (G1), the operational mode is switched from the entry mode to a special printing mode. At this time point, "Special Print" is displayed as a title on an upper half portion of the display screen 91, and "EL print" is displayed in reverse video on a lower half portion of the same (G2). The displayed image "EL print" represents an option for selecting the elongated printing. Selection of the option enables the character string image to be printed in elongated printing. Further, the special printing includes, in addition to the EL print, one in which an image of an entered character string is repeatedly printed, and another in which an image of an entered character string is deformed in the direction of width of the tape.

If the "EL print" is selected (S2) in the special printing mode, the display screen changes from the screen G2 to a screen G3, in which "Long EL" is displayed in reverse video in place of "EL print". Similarly to "EL print", the displayed image "Long EL" is an abbreviated name of the "long EL print" for an option for selecting the long EL print. Selection of the option enables the character string image to be printed in the long EL print.

Further, if the down arrow key 830*d* is depressed (S3) when the screen display displayed the G3, the screen display changes to a screen G4, in which "Short EL" is displayed in reverse video in place of "Long EL". Similarly, if the down arrow key 830*d* is depressed (S4) when the screen display displays the G4, the screen display changes to a screen G5, and if the same is further depressed, the screen display changes to a screen G6. In the screens G5 and G6, "Convex EL" and "Concave EL" are displayed in reverse video, respectively. The "Short EL", "Convex EL", and "Concave EL" are also abbreviated names of the "short EL print", "convex EL print", and "concave EL print" for respective options for selecting the "short EL print", "convex EL print", and "concave EL print", similarly to the "long EL print". During display of any of the screens G3 to G6, if the up arrow key 830*c* and the down arrow key 830*d* are alternately depressed, adjacent screens are alternately displayed, accordingly.

As described above, according to the tape printing apparatus 1, from the four kinds of elongation patterns, "Long EL", "Short EL", "Convex EL" and "Concave EL", the user can select a desired one for printing. Thus, the elongation pattern-selecting means of the invention is implemented by the keyboard 8, the display 9, a program for displaying these elongation patterns on the display screen and enabling the user to select a desired one from them.

Assuming that the selection key 840 is depressed to select one of the "Long EL", "Short EL", "Convex EL" and "Concave EL", the operational mode is switched to "the print execution-confirming mode" to display a screen G7. The print execution-confirming mode is a mode in which whether the printing should be executed is confirmed, and whenever the down arrow key 830*d* or the up arrow key 830*c* is depressed (S7), "EXECUTE" (G7) or "CANCEL" (G8) is displayed for selection. If the selection key 840 is depressed (S8) to select the "EXECUTE", the character string image is printed on the tape T in the mode selected from the "Long EL", "Short EL", "Convex EL" and "Concave EL".

Next, a process for forming a print image by the "EL print" will be described in detail with reference to FIGS. 7 to 11B. In these printing methods, data (basic image data) of a basic image, i.e. data of an image identical to one to be printed in normal printing is stored in the temporary storage buffer 245 of the RAM 240 in a state developed into a dot matrix, and then between each predetermined adjacent pair of dot lines (columns of dots) which extend in a direction corresponding to a vertical direction of the FIG. 7B image, a predetermined new dot line is added and the resulting dot lines are stored in the print buffer 244 of the RAM 240.

The temporary storage buffer 245 has an area (capacity) which can store the maximum amount of data to be normally printed by the tape printing apparatus 1, while the print buffer 244 has an area (capacity) corresponding to an area which can be printed on the tape T. The CPU 210 reads data corresponding to the basic image from the CG-ROM 230, etc., develops the data into a dot matrix, and stores the developed data in the temporary storage buffer 245. Therefore, data-developing means of the invention is implemented by the CPU 210, the temporary storage buffer 244, the CG-ROM 230, and a program for developing data into a dot matrix and storing the developed data in the temporary storage buffer 245.

Figure 7A:
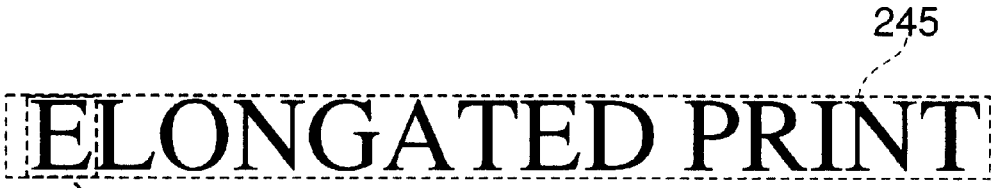
FIG. 7A is a schematic representation of a character string image stored in a print buffer.
Figure 7B:
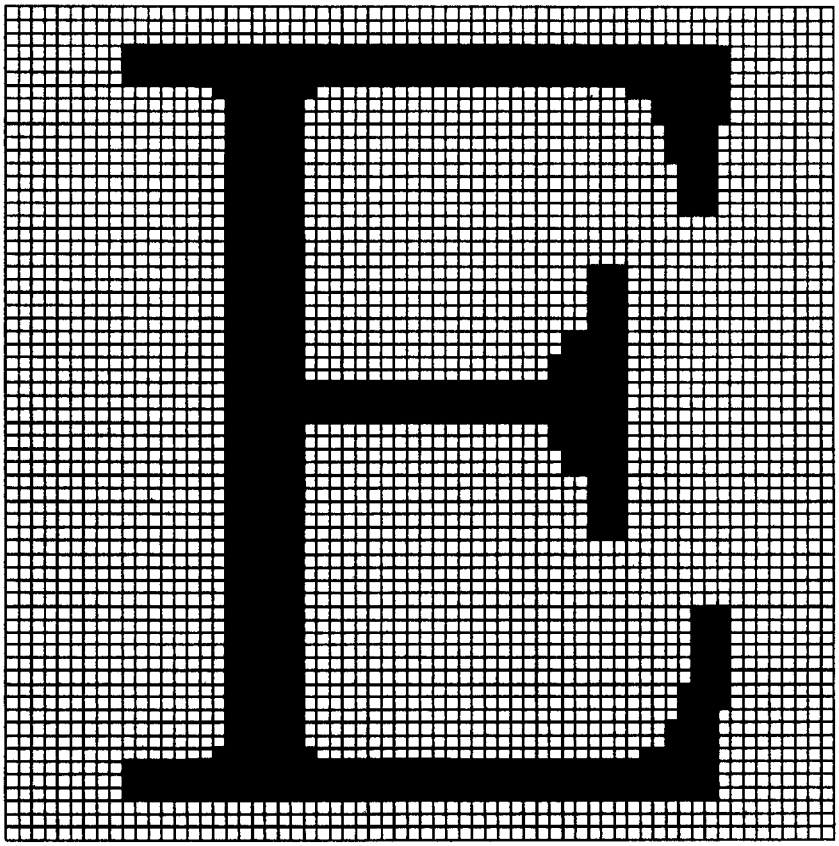
FIG. 7B shows part of the FIG. 10A character string image on an enlarged scale.

FIG. 7A is a schematic representation of a basic image of the entered character string stored in the temporary storage buffer 245, while FIG. 7B shows a character image of "E" of the character string on an enlarged scale. A print image in the EL print is formed by duplicating each vertical dot line of the basic image selected according to the selected elongation pattern, one or more times, and then storing the duplicated data into the print buffer 244.

Now, methods of calculating the number of times of duplication of each dot line employed in the "long EL print", "short EL print", "convex EL print" and "concave EL print" will be described. It should be noted that the tape T to be loaded in the tape printing apparatus 1 includes various types having respective different widths, and in consideration of the relationship between a tape width and an appearance of the elongated image, the maximum number of times of duplication of each dot line is prescribed for each tape width. TABLE 1 below shows values of the maximum number of times of duplication prescribed for each tape width.

TABLE 1

| Tape width (mm) | 6 | 9 | 12 | 18 | 24 |
|---|---|---|---|---|---|
| Max. No. of times of duplication | 4 | 5 | 6 | 7 | 8 |

As shown in TABLE 1, when the tape widths are 6, 9, 12, 18, and 24 mm, the maximum numbers Rmax of times of duplication are set to 4, 5, 6, 7 and 8.

First, in the "long EL print" and "short EL print", assuming that numbers 1, 2, 3, . . . (hereinafter referred to as "line numbers") sequentially assigned to respective dot lines of the print buffer 244 each extending in the direction of width of the tape T, starting from a forward end (left side end as viewed in FIG. 7A) of the print buffer with respect to a direction corresponding to the direction of length of the tape T are each represented by ln, and a total number of dot lines of a basic image to be printed by L, the number S of times of duplication of each dot line employed in the "long EL print" and "short EL print" can be calculated respectively by the following equations:

$$S=(R\max-1)\times|\sin\{(ln/L)\times 2\pi\}|+1 \quad (1)$$

$$S=(R\max-1)\times|\sin\{(ln/L)\times 4\pi\}|+1 \quad (2)$$

In the above equations (1) and (2), values of the number of times of duplication of each dot line obtained assuming that the tape width is 12 mm (in this case, from TABLE 1, Rmax=6), and the total number L of dot lines of the basic image is equal to 288 are shown in TABLE 2 and TABLE 3 below:

TABLE 2

| Line Number ln | 1 | 2 | 3 | . . . | 71 | 72 | 73 | . . . |
|---|---|---|---|---|---|---|---|---|
| (ln/L) × 2π | 0.022 | 0.044 | 0.065 | . . . | 1.549 | 1.571 | 1.593 | . . . |
| sin{(ln/L) × 2π} | 0.022 | 0.044 | 0.065 | . . . | 1.000 | 1.000 | 1.000 | . . . |
| (Rmax-1) × \|sin{(ln/L) × 2π} \|+ 1 | 1.109 | 1.218 | 1.327 | . . . | 5.999 | 6.000 | 5.999 | . . . |
| No. of Times of Duplication | 1 | 1 | 1 | . . . | 6 | 6 | 6 | . . . |
| **Line Number ln** | **143** | **144** | **145** | . . . | **215** | **216** | **217** | . . . |
| (ln/L) × 2π | 3.120 | 3.142 | 3.163 | . . . | 4.691 | 4.712 | 4.734 | . . . |
| sin{(ln/L) × 2π} | 0.022 | 0.000 | −0.022 | . . . | −1.000 | −1.000 | −1.000 | . . . |
| (Rmax-1) × \|sin{(ln/L) × 2π} \|+ 1 | 1.109 | 1.000 | 1.109 | . . . | 5.999 | 6.000 | 5.999 | . . . |
| No. of Times of Duplication | 1 | 1 | 1 | . . . | 6 | 6 | 6 | . . . |
| **Line Number ln** | **286** | **287** | **288** | . . . | | | | |
| (ln/L) × 2π | 6.240 | 6.261 | 6.283 | . . . | | | | |
| sin{(ln/L) × 2π} | −0.044 | −0.022 | 0.000 | . . . | | | | |
| (Rmax-1) × \|sin{(ln/L) × 2π} \|+ 1 | 1.218 | 1.109 | 1.000 | . . . | | | | |
| No. of Times of Duplication | 1 | 1 | 1 | . . . | | | | |

L = 288
Rmax = 6

TABLE 3

| Line Number ln | 1 | 2 | 3 | . . . | 35 | 36 | 37 | . . . |
|---|---|---|---|---|---|---|---|---|
| (ln/L) × 4π | 0.044 | 0.087 | 0.131 | . . . | 1.527 | 1.571 | 1.614 | . . . |
| sin{(ln/L) × 4π} | 0.044 | 0.087 | 0.131 | . . . | 0.999 | 1.000 | 0.999 | . . . |
| (Rmax-1) × \|sin{(ln/L) × 4π} \|+ 1 | 1.218 | 1.436 | 1.653 | . . . | 5.995 | 6.000 | 5.995 | . . . |
| No. of Times of Duplication | 1 | 1 | 2 | . . . | 6 | 6 | 6 | . . . |
| **Line Number ln** | **71** | **72** | **73** | . . . | **107** | **108** | **109** | . . . |
| (ln/L) × 4π | 3.098 | 3.142 | 3.185 | . . . | 4.669 | 4.712 | 4.756 | . . . |
| sin{(ln/L) × 4π} | 0.044 | 0.000 | −0.044 | . . . | −0.999 | −1.000 | −0.999 | . . . |
| (Rmax-1) × \|sin{(ln/L) × 4π} \|+ 1 | 1.218 | 1.000 | 1.218 | . . . | 5.995 | 6.000 | 5.995 | . . . |
| No. of Times of Duplication | 1 | 1 | 1 | . . . | 6 | 6 | 6 | . . . |

TABLE 3-continued

| Line Number ln | 143 | 144 | 145 | . . . | 179 | 180 | 181 | . . . |
|---|---|---|---|---|---|---|---|---|
| (ln/L) × 4π | 6.240 | 6.283 | 6.327 | . . . | 7.810 | 7.854 | 7.898 | . . . |
| sin{(ln/L) × 4π} | −0.044 | 0.000 | 0.044 | . . . | 0.999 | 1.000 | 0.999 | . . . |
| (Rmax-1) × \|sin{(ln/L) × 4π} \|+ 1 | 1.218 | 1.000 | 1.218 | . . . | 5.995 | 6.000 | 5.995 | . . . |
| No. of Times of Duplication | 1 | 1 | 1 | . . . | 6 | 6 | 6 | . . . |

L = 288
Rmax = 6

Line numbers ln values of which are actually shown in TABEL 2 and TABLE 3 are ones whose number of times of duplication are equal to "1", and the maximum, as well as ones immediately before and after these line numbers ln. Each value of the number S of times of duplication is obtained by rounding off the result of calculation by using the equation (1) or (2) to obtain an integer.

Since the number S of times is calculated by using the equations including the sine function, it is increased or decreased according to the sine function. Therefore, by duplicating each dot line based on the thus calculated number S of times of duplication, and storing the duplicated dot lines sequentially into the print buffer 244, the "long EL print" and the "short EL print" produces respective images in which the elongation is carried out over the basic image in a manner repeating elongation cycle a plurality of times (see FIGS. 5B and 5C). Further, the short EL print produces a print image which more rapidly changes in elongation rate than one produced by the long EL print. It should be noted that instead of calculating the sine function by the equation (1) or 2, a data table defining values of the number S of times of duplication on a dot line by dot line basis may be provided in advance and searched to obtain the number S of times of duplication. This makes it possible to calculate the number of times of duplication at a higher speed.

Further, the number S of times of duplication of each dot line employed in the "convex EL print" and "concave EL print" can be calculated respectively by the following equations:

$$S=(R\max-1)\times|\sin\{(ln/L)\times\pi\}|+1$$

$$S=(R\max-1)\times|\cos\{(ln/L)\times\pi\}|+1$$

In the above equations (3) and (4), values of the number S of times of duplication of each dot line obtained assuming that the total number L of dot lines of the basic image is equal to 288 and the maximum number Rmax of times of duplication is equal to 6, are respectively shown in TABLE 4 and TABLE 5 below. Line numbers ln values of which are actually shown in TABEL 4 and TABLE 5 are ones whose number of times of duplication are equal to "1", and the maximum, as well as ones immediately before and after these line numbers ln.

TABLE 4

| Line Number ln | 1 | 2 | 3 | . . . | 71 | 72 | 73 | . . . |
|---|---|---|---|---|---|---|---|---|
| (ln/L) × π | 0.011 | 0.022 | 0.033 | . . . | 0.774 | 0.785 | 0.796 | . . . |
| sin{(ln/L) × π} | 0.011 | 0.022 | 0.033 | . . . | 0.699 | 0.707 | 0.715 | . . . |
| (Rmax-1) × \|sin{(ln/L) × π} \|+ 1 | 1.055 | 1.109 | 1.164 | . . . | 4.497 | 4.536 | 4.574 | . . . |
| No. of Times of Duplication | 1 | 1 | 1 | . . . | 4 | 5 | 5 | . . . |
| **Line Number ln** | **143** | **144** | **145** | . . . | **215** | **216** | **217** | . . . |
| (ln/L) × π | 1.560 | 1.571 | 1.582 | . . . | 2.345 | 2.356 | 2.367 | . . . |
| sin{(ln/L) × π} | 1.000 | 1.000 | 1.000 | . . . | 0.715 | 0.707 | 0.699 | . . . |
| (Rmax-1) × \|sin{(ln/L) × π} \|+ 1 | 6.000 | 6.000 | 6.000 | . . . | 4.574 | 4.536 | 4.497 | . . . |
| No. of Times of Duplication | 6 | 6 | 6 | . . . | 5 | 5 | 4 | . . . |
| **Line Number ln** | **286** | **267** | **288** | . . . | | | | |
| (ln/L) × π | 3.120 | 3.131 | 3.142 | . . . | | | | |
| sin{(ln/L) × π} | 0.022 | 0.011 | 0.000 | . . . | | | | |
| (Rmax-1) × \|sin{(ln/L) × π} \|+ 1 | 1.109 | 1.055 | 1.000 | . . . | | | | |
| No. of Times of Duplication | 1 | 1 | 1 | . . . | | | | |

L = 288
Rmax = 6

TABLE 5

| Line Number ln | 1 | 2 | 3 | . . . | 71 | 72 | 73 | . . . |
|---|---|---|---|---|---|---|---|---|
| (ln/L) × π | 0.011 | 0.022 | 0.033 | . . . | 0.774 | 0.785 | 0.796 | . . . |
| cos{(ln/L) × π} | 1.000 | 1.000 | 0.999 | . . . | 0.715 | 0.707 | 0.699 | . . . |
| (Rmax-1) × \|cos{(ln/L) × π} \|+ 1 | 6.000 | 5.999 | 5.997 | . . . | 4.574 | 4.536 | 4.497 | . . . |
| No. of Times of Duplication | 6 | 6 | 6 | . . . | 5 | 5 | 4 | . . . |
| Line Number ln | 143 | 144 | 145 | . . . | 215 | 216 | 217 | . . . |
| (ln/L) × π | 1.560 | 1.571 | 1.582 | . . . | 2.345 | 2.356 | 2.367 | . . . |
| cos{(ln/L) × π} | 0.011 | 0.000 | −0.011 | . . . | −0.699 | −0.707 | −0.715 | . . . |
| (Rmax-1) × \|cos{(ln/L) × π} \|+ 1 | 1.055 | 1.000 | 1.055 | . . . | 4.497 | 4.536 | 4.574 | . . . |
| No. of Times of Duplication | 1 | 1 | 1 | . . . | 4 | 5 | 5 | . . . |
| Line Number ln | 286 | 287 | 288 | . . . | | | | |
| (ln/L) × π | 3.120 | 3.131 | 3.142 | . . . | | | | |
| cos{(ln/L) × π} | −1.000 | −1.000 | −1.000 | . . . | | | | |
| (Rmax-1) × \|cos{(ln/L) × π} \|+ 1 | 5.999 | 6.000 | 6.000 | . . . | | | | |
| No. of Times of Duplication | 6 | 6 | 6 | . . . | | | | |

L = 288
Rmax = 6

As is clear from the above TABLE 3 and TABLE 4, in the "convex EL print", the number of times of duplication is progressively increased from the forward end of the character string image to a center of the same, and is progressively decreased from the center to the rearward end of the same. Therefore, an image is obtained which is larger in the elongation rate in the central portion of the character string image than in opposite end portions of the same (see FIG. 5D). On the other hand, in the "concave EL print", the number of times of duplication is progressively decreased from the forward end of the character string image to the center of the same, and is progressively increased from the center to the rearward end of the same. Therefore, an image is obtained which is smaller in the elongation rate in the central portion of the character string image than in opposite end portions of the same (see FIG. 5E). It should be noted that the equations (1) to (4) described above are stored in advance in the ROM 220 (elongation pattern storage means) as a duplicating time calculation program.

Figure 8A:
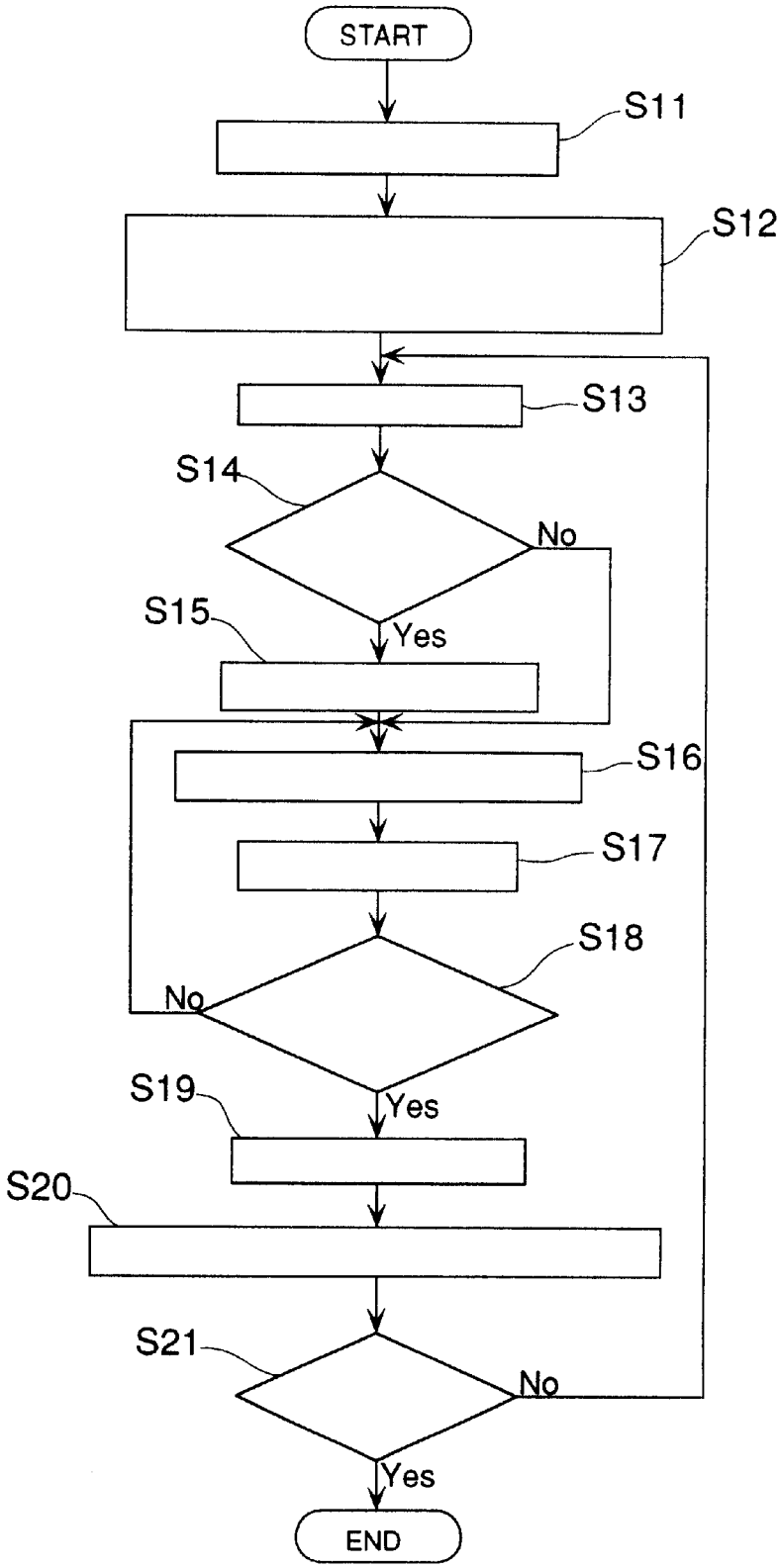
Figure 9:
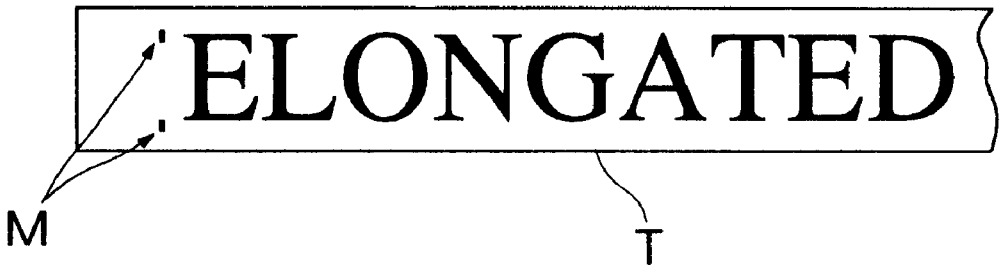
FIG. 9 is a diagram showing a tape printed with cutting marks.

Next, the internal processing executed by the control block 200 for forming a print image in the print buffer 244 will be described with reference to FIGS. 8A and 8B. When "EXECUTE" of special printing is selected at S7 in FIG. 6, the basic image data is stored in the temporary storage buffer 245 to thereby form print data which is identical to print data formed when normal printing is carried out.

Then, a line number counter for counting the line number ln, a one-line duplication counter for counting the number S of times of duplication of a dot line to be duplicated, a print data read pointer (print data R pointer) for designating an address with reference to which reading of each dot line of the character string image stored in the temporary storage buffer 245 is carried out, and a print data write pointer (print data W pointer) for designating an address with reference to which writing of each duplicated dot line into the print buffer 244 is carried out are initialized (S12). More specifically, 0 is assigned to certain variables defined in advance to serve as the line number counter and one-line duplication counter. Further, certain variables are defined to serve as the print data R pointer and the print data W pointer, and these variable are set such that they designate the respective addresses for leading dot lines of the data stored in the temporary storage buffer 245 and the print buffer 244. It should be noted that in the following description and FIGS. 8A, 8B, the print data R pointer and the print data W pointer are collectively denoted as "print data R/W pointer".

Then, the number of times of one-line duplication indicative of the number of times of duplication of each dot line is set to 1 (S13). More specifically, a certain variable is defined in advance to represent the number of times of duplication of each line, and 1 is assigned to this variable at this time point. This causes each dot line of the character string image stored in the temporary storage buffer 245 to be duplicated at least one time.

Then, it is determined at a step S14 whether or not the dot line at the address currently indicated by the present print data R pointer is in an area on which "EL print" is to be carried out. More specifically, the temporary storage buffer 245 stores data of the character string image together with data of the front and rear margins of a label to be actually made, and therefore it is determined at the step S14 whether the dot line of dots whose address is indicated by the print data R pointer belongs to the margins. In the dot lines for these margins, there are no dots constituting the print image, and hence these dot lines are outside the above area (No to S14), so that the "EL print" of the dot line is not carried out. The dot line, however, is written as a line formed of blank dots, into the print buffer 244 (S16).

Further, the tape printing apparatus 1 allows the user to set the margin lengths as desired. However, if the length of the margin on the forward end of the tape is set to an extremely small value (e.g. approximately 1 mm), the distance between the print head 46 and the tape cutter 131 does not allow the tape T to be automatically cut such that the tape T can have the margin. For this reason, a pair of cut marks M, M are printed in upper and lower portions of the tape T in the direction of width thereof, respectively, so as to inform the user of an imaginary cutoff line. That is, when the user cuts the tape T e.g. by scissors along the imaginary cutoff line between the cut marks M, M, a margin having a length set by the user is formed on the forward end side of the tape T.

In an identical dot line in the print buffer 244, there is stored positive dot data of several dots required for printing the cut marks M, M on the tape T. If the dots forming the cut mark M are duplicated more than one time, the cut marks per se become too thick, and this can hinder a desired margin from being formed. To avoid this inconvenience, the dot lines corresponding to the cut marks M, M are also considered outside the above-mentioned area for the EL print, and the dot lines are prevented from being duplicated more than one time (No to S14).

On the other hand, if the dot line indicated by the print data R pointer is judged to be within the area for the EL print, by using a selected one of the equations (1) to (4), the number S of times of one-line duplication is calculated at a step S15. Then, each dot line at the address designated by the print data R pointer (dot line to be duplicated) is written into the address in the print buffer 244 designated by the print data W pointer (S16).

Then, the one-line duplication counter is incremented by 1 (S17), and it is determined at a step S18 whether or not the count of the one-line duplication counter is equal to the number of times of one-line duplication. If the count is not equal to the number of times of one-line duplication (No to S18), the dot line indicated by the print data R pointer is written into the address (next address) following the preceding address into which the dot line was written on the preceding occasion (S16).

The processing from the steps S16 through S18 is repeatedly carried out (writing loop process), the dot lines to be duplicated are written into the print buffer 244 a number of times corresponding to the number of times of one-line duplication. When the count of the one-line duplication counter becomes equal to the number of times of one-line duplication (Yes to S18), the writing loop process is terminated, and the count of the one-line duplication counter is cleared, i.e. 0 is assigned to the one-line duplication counter (S19). Then, the count of the line number counter is incremented by one, and the print data R/W pointer is updated to designate the following address (S20).

Thus, the processing of the steps S13 to S20 is repeatedly carried out, to form the print image in the print buffer 244, and i.e. write all the data in the temporary storage buffer 245 into the print buffer 244 (Yes to S21), followed by terminating the internal processing.

Figure 10A:
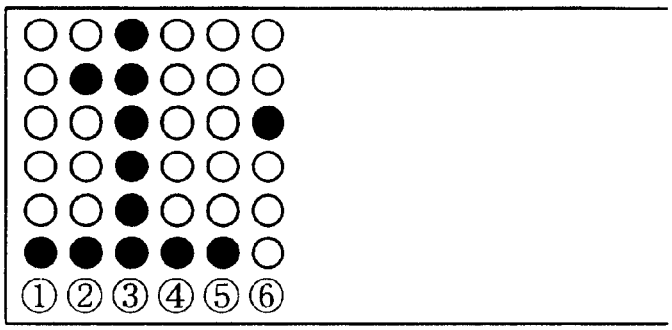
FIG. 10A is a schematic representation of part of a temporary storage buffer.
Figure 10B:
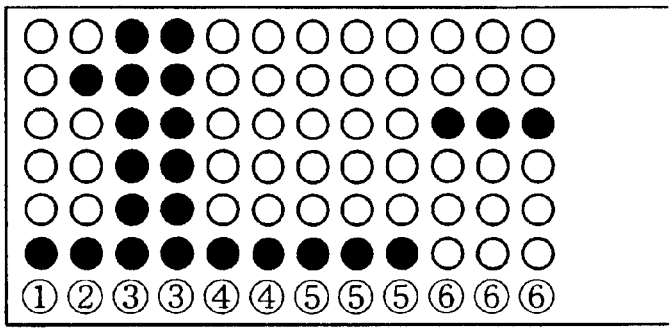
FIG. 10B is a schematic representation of part of a print buffer.

FIGS. 10A and 10B are schematically illustrate a manner of duplicating and writing dot lines in the temporary storage buffer 245 into the print buffer 244, though they are not conformant to the above equations. In the dot lines indicated by the respective encircled numbers which are stored as shown in FIG. 10A, assuming that the numbers of times of duplication of the dot lines indicated by the respective encircled 1 and 2 are equal to 1, those for the dot lines indicated by the respective encircled 3 and 4 are equal to 2, and those for the dot lines indicated by the respective encircled 5 and 6 are equal to 3, each dot line is written into the print buffer 244 each specified number of times of duplication, as shown in FIG. 10B.

Then, after completing the internal processing, the data formed in the print buffer 244 is output to the P-CON 250, and printed on the tape T by means of the print head 46 driven by the head driver 272. From the printed tape T, a label is formed which bears the character string image printed in any of the "long EL print", "short EL print", "convex EL print", and "concave EL print" (see FIGS. 5B to 5E).

Although, in the above internal processing, the temporary storage buffer 245 is used to form the print image in the print buffer 244, this is not limitative, but the temporary storage buffer 245 may be omitted and the print image may be directly formed based on the original character string image. In this case, first, the data for the normal printing is loaded in the print buffer 244. Then, the writing process at the step S16 is carried out only when the number of times of one-line duplication is equal to 2 or larger. Further, before carrying out this writing process, all the dot lines following the current dot line to be duplicated are each shifted by one dot line, and the print data R/W pointer is caused to designate the address of the following dot line. This makes it possible to form the print image while omitting the temporary storage buffer, and hence the capacity of the RAM 240 can be minimized, or the area thereof for the temporary storage buffer can be allocated to other buffers, such as the print buffer.

Figure 11A:
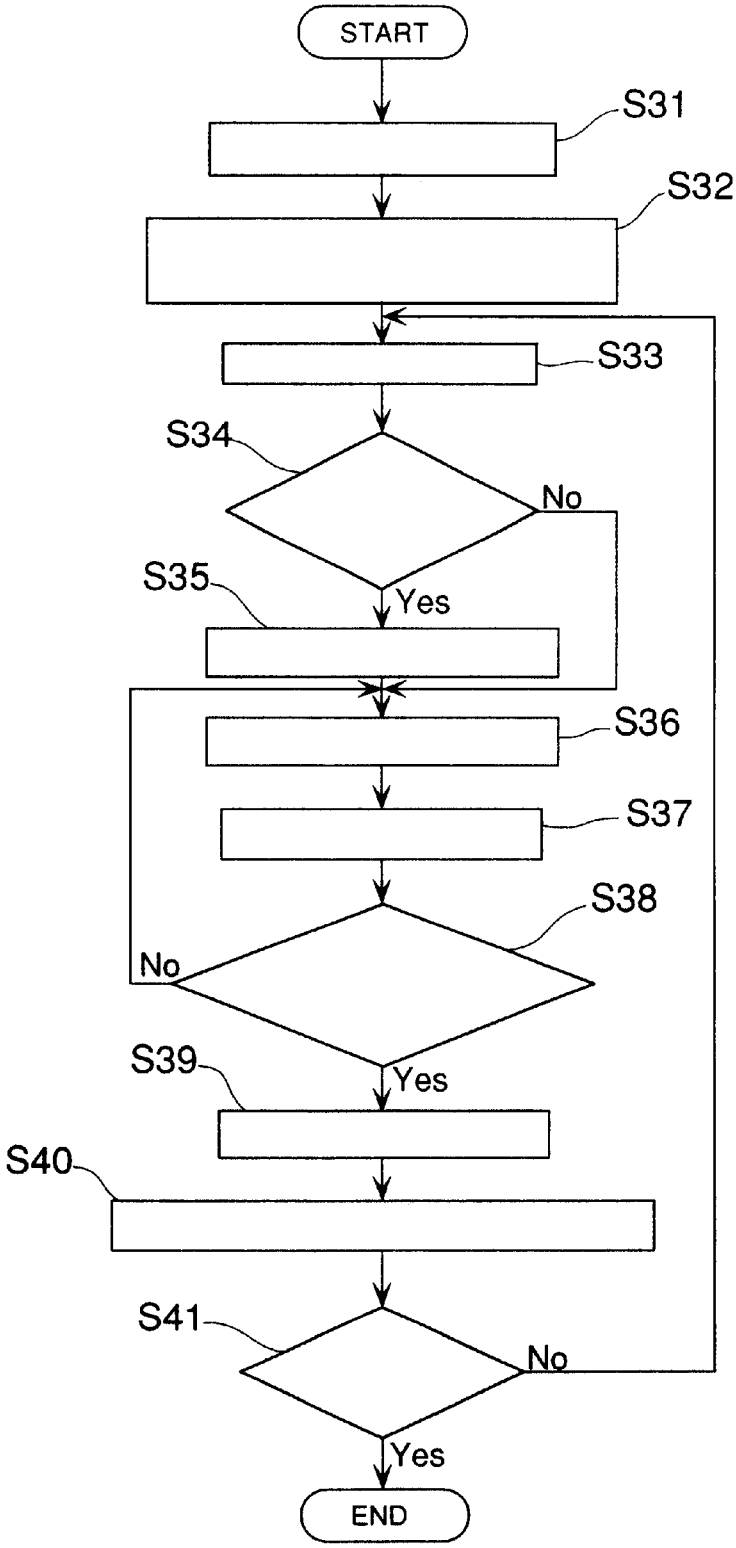

Further, when the print image within the print buffer 244 is printed on the tape T. the printing may be carried out not after forming the whole print image as described above, but after forming each dot line (to be printed) of the print image, i.e. on a dot line by dot line basis. FIGS. 11A and 11B shows a flowchart of a routine for the internal processing and printing processing executed according to this variation of the embodiment of the invention. It should be noted that the steps S31 to S41 shown in the figures substantially correspond to the steps S11 to S21 in FIGS. 8A, 8B, respectively, and hence description of identical ones of them will be omitted.

In this routine, the temporary storage buffer is not used, but the normal print data is directly formed in the print buffer 244. Then, the line number counter, a one-line repetition counter, and the print data R pointer are initialized. The one-line repetition counter is substantially identical to the one-line duplication counter described hereinabove, and used for counting the number of printing operations carried out for each dot line (the number of times of one-line repetition printing).

Then, similarly to the number of times of one-line duplication, the number of times of one-line repetition printing is set to 1 (S33). Therefore, each dot line of the character string image in the print buffer is printed at least one time.

Thereafter, if the dot line at the address currently indicated by the print data R pointer is within the area for "EL print" (Yes to S34), by using a selected one of the equations (1) to (4), the number S of times of printing is calculated according to the line number ln (S35). Then, the dot line at the address indicated by the print data R pointer, i.e. data of the dot line to be printed is outputted to the P-CON 250, and printed by the print head 46 driven by the head driver 272 (S36).

Then, the one-line repetition counter is incremented by one (S37), and the above dot line for the EL print is repeatedly printed until the count of the one-line repetition counter becomes equal to the same value as the calculated number of times of one-line repetition printing (S36 to S38). Thereafter, the count of the one-line repetition counter is cleared (S39). Further, the line number counter is incremented by one, and at the same time the print data R pointer is updated to indicate the following address (S40).

The steps S33 to S40 described above are repeatedly carried out, whereby each dot line of the character string image is sequentially printed on the tape T (Yes to S41), and then the internal processing and the printing processing are terminated. Thus, a label having the character string image printed in "long EL print", "short EL print", "convex EL print" or "concave EL print" is formed (see FIGS. 5B to 5E).

When the print image is printed while being formed as in this variation, the process for calculating the number of times of printing a dot line (S35) and the printing process (S36) are carried out by multi-task processing, and therefore, a time period from selection (S8) of "EXECUTE" in the print execution-confirming mode up to delivery of the printed label from the tape printing apparatus 1 can be reduced.

As described above, according to the embodiment of the invention and variation thereof, a print image elongated along the length of the tape can be formed by duplicating or repeatedly printing dot lines of a basic image according to a desired elongation pattern, whereby labels can be made which are richer in variety than those made by the prior art. For instance, a label made by the convex EL print (see FIG. 5D) gives an impression of a label attached to an outwardly curved surface protruding toward the viewer, even if it is actually attached to a flat surface, while a label made by the concave EL print (see FIG. 5E) gives an impression of a label attached to an inwardly curved surface indenting away from the viewer.

Further, if a label which is increased in the elongation rate toward opposite ends of the label, such as a label printed in the concave EL print, is attached to an outer or inner surface of a cylindrical object, the character string image appears to be printed in proper lettering when the label is viewed from the front. It should be noted that to make the attached label appear in a more suitable lettering, assuming that the radius of the cylindrical object is r, it is preferred that as to a portion from the center to the right end of the character sting image, the number S of times of duplication of one dot line is calculated by using the following equation (5), while as to a portion from the center to the left end of the character string image, the same is calculated by using the following equation (6):

$$S=r\times\sin^{-1}(|ln-L/2|/r)-r\times\sin^{-1}(|ln-1)-L/2|/r\}| \quad (5)$$

$$S=r\times\sin^{-1}(|ln-L/2|/r)-r\times\sin^{-1}(|ln+1)-L/2|/r\}| \quad (6)$$

It should be noted that as to the line number ln in the above equations (5) and (6), a dot line located in the center of the character string image is assigned a value of 1, and the line number ln is increased toward the opposite ends of the character string image. Further, of $\sin^{-1}$ is smaller than $\pi/2$, and the total length of the label does not exceed 2r.

Further, although in the above embodiments, the equations (1) to (4) are used for calculating the number of times of duplication (or the number of times of repetition printing), this is not limitative, but any equation may be employed so long as it can duplicate or print dot lines a plurality of times.

Further, although in the embodiment, the character string image is formed as a print image, this is not limitative, but the invention can be applied to cases where print images of various kinds of images such as graphics and pictures are formed.

Still further, in the above embodiments, the invention is applied to the tape printing apparatus, this is not limitative, but it may be applied to a stamp making apparatus which prints a desired image on an ink ribbon, and makes a stamp by using the printed ink ribbon tape as a mask, electronic apparatuses, such as word processors. When it is applied to a word processor, a printing medium (print paper in the case of the word processors) can be used which is relatively long in a direction orthogonal to the direction of a sequence of characters. Therefore, just as the basic image developed into a dot matrix is elongated in the horizontal direction as described above, it can be elongated in the vertical direction. It should be noted that the print image may be elongated both in the vertical and horizontal directions, so long as the appearance of the resulting image does not matter.

It is further understood by those skilled in the art that the foregoing is a preferred embodiment of the invention, and that various changes and modifications may be made without departing from the spirit and scope thereof.

What is claimed is:

1. An image-forming device in which, in a condition of defining one of a direction of length of a basic image and a direction of width of said basic image as a predetermined axial direction and the other as an axial direction orthogonal to said predetermined axial direction and also defining at least one of said predetermined axial direction and said axial direction orthogonal to said predetermined axial direction as an elongation direction, the image-forming device (1) represents by a specific elongation pattern along said predetermined axial direction an elongation rate of said basic image that varies between at least two points in said predetermined axial direction of said basic image and (2) elongates a portion of said basic image where said elongation rate is applied in said elongation direction of said basic image in accordance with said elongation rate based on said specific elongation pattern to thereby form a deformed image from said basic image, the image-forming device comprising:

elongation pattern storage means for storing elongation data of at least said specific elongation pattern;

data-developing means for developing basic image data representative of said basic image into a dot matrix;

duplicating means for duplicating each dot line of unit length of said basic image data extending in a direction orthogonal to said elongation direction, based on said elongation data, the duplicating means being capable of duplicating each dot line such that a number of times of duplication can be different for each dot line; and addition means for adding a dot line generated by duplication of said each dot line by said duplicating means between an original dot line before having been duplicated and a following dot line in said elongation direction adjacent to said original dot line;

wherein the elongation data includes an equation for calculating a number of times of duplication to be carried out, in which each dot line is represented by a line number and the number of times of duplication of the dot line represented by an arbitrary line number is represented as a function having the arbitrary line number as a parameter.

2. An image-forming device according to claim 1, wherein said elongation data stored in said elongation pattern storage means comprises elongation data of a plurality of elongation patterns, the image-forming device including elongation pattern-selecting means for selecting said specific elongation pattern from said plurality of elongation patterns.

3. An image-forming device according to claim 2, wherein said basic image comprises at least one character image, and wherein said plurality of elongation patterns include an elongation pattern for varying said elongation rate of said basic image in units of length smaller than a horizontal width of one character image in said basic image or in units of length smaller than a vertical width of said one character image in said basic image.

4. An image-forming device according to claim 3, wherein said elongation data includes data of a maximum number of times of duplication permitted to be carried for said each dot line, said maximum number being dependent on a size of an image area in which said deformed image is to be formed.

5. An image-forming device according to claim 2 or 3, wherein said plurality of elongation patterns include one for varying said elongation rate of said basic image in a continuous manner.

6. An image-forming device according to claim 1 or 2, wherein said elongation data includes data of a maximum number of times of duplication permitted to be carried for said each dot line, said maximum number being dependent on a size of an image area in which said deformed image is to be formed.

7. An image-forming device according to claim 1, wherein said data-developing means comprises a temporary storage buffer for loading said basic image data therein, and wherein said duplication means comprises a line number counter for counting a number of said each dot line of said basic image data, a duplication counter for counting a number of times of said duplication, a print data read pointer for designating an address of said temporary storage buffer from which said each dot line is read out, a print buffer into which said each dot line read out from said temporary storage buffer is written, and a print data write pointer for designating an address of said print buffer at which said each dot line read from said temporary storage buffer is written.

8. An image-forming device according to claim 1, wherein said data-developing means comprises a buffer for loading said basic image data therein, and wherein said duplication means comprises a line number counter for counting a number of said each dot line of said basic image data, a one-line repetition counter for counting a number of times of repetition of reading of said each dot line from said buffer, and a print data read pointer for designating an address of said buffer from which said each dot line is read out.

9. An image-forming device according to claim 1, wherein said equation calculates a print pattern Long EL and comprises:

$$S=(R\max-1)\times|\sin\{(ln/L)\times 2\pi\}|+1,$$

where S is the number of times of duplication of each dot line employed in the pattern Long EL, Rmax is the maximum number of times of duplication, ln is the line number, and L is the total number of dot lines to be printed.

10. An image-forming device according to claim 1, wherein said equation calculates a print pattern Short EL and comprises:

$$S=(R\max-1)\times|\sin\{(ln/L)\times 4\pi\}|+1,$$

where S is the number of times of duplication of each dot line employed in the pattern Short EL, Rmax is the maximum number of times of duplication, ln is the line number, and L is the total number of dot lines to be printed.

11. An image-forming device according to claim 1, wherein said equation calculates a print pattern Convex EL and comprises:

$$S=(R\max-1)\times|\sin\{(ln/L)\times \pi\}|+1,$$

where S is the number of times of duplication of each dot line employed in the pattern Convex EL, Rmax is the maximum number of times of duplication, ln is the line number, and L is the total number of dot lines to be printed.

12. An image-forming device according to claim 1, wherein said equation calculates a print pattern Concave EL and comprises:

$$S=(R\max-1)\times|\cos\{(ln/L)\times \pi\}|+1,$$

where S is the number of times of duplication of each dot line employed in the pattern Concave EL, Rmax is the maximum number of times of duplication, ln is the line number, and L is the total number of dots lines to be printed.

13. A printing apparatus comprising:

an image-forming device for, in a condition of defining one of a direction of length of a basic image and a direction of width of said basic image as a predetermined axial direction and the other as an axial direction orthogonal to said predetermined axial direction and also defining at least one of said predetermined axial direction and said axial direction orthogonal to said predetermined axial direction as an elongation direction, representing by a specific elongation pattern along said predetermined axial direction an elongation rate of said basic image that varies between at least two points in said predetermined axial direction of said basic image and elongating a portion of said basic image where said elongation rate is applied in said elongation direction of said basic image in accordance with said elongation rate based on said specific elongation pattern to thereby form a deformed image from said basic image, the image-forming device comprising:

elongation pattern storage means for storing elongation data of at least said specific elongation pattern;

data-developing means for developing basic image data representative of said basic image into a dot matrix;

duplicating means for duplicating each dot line of unit length of said basic image data extending in a direction orthogonal to said elongation direction, based on said elongation data, the duplicating means being capable of duplicating each dot line such that a number of times of duplication can be different for each dot line; and addition means for adding a dot line generated by duplication of said each dot line by said duplicating means between an original dot line before having been duplicated and a following dot line in said elongation direction adjacent to said original dot line; and printing means for printing said deformed image formed by said image-forming device;

wherein the elongation data includes an equation for calculating a number of times of duplication to be carried out, in which each dot line is represented by a line number and the number of times of duplication of the dot line represented by an arbitrary line number is represented as a function having the arbitrary line number as a parameter.

14. A method of forming an image, in a condition of defining one of a direction of length of a basic image and a direction of width of said basic image as a predetermined axial direction and the other as an axial direction orthogonal to said predetermined axial direction and also defining at least one of said predetermined axial direction and said axial direction orthogonal to said predetermined axial direction as an elongation direction, representing by a specific elongation pattern along said predetermined axial direction an elongation rate of said basic image that varies between at least two points in said predetermined axial direction of said basic image and elongating a portion of said basic image where said elongation rate is applied in said elongation direction of said basic image in accordance with said elongation rate based on said specific elongation pattern to thereby form a deformed image from said basic image, the method comprising the steps of:

developing basic image data representative of said basic image into a dot matrix;

duplicating each dot line of unit length of said basic image data extending in a direction orthogonal to said elongation direction, based on elongation data of at least said specific elongation pattern, the step of duplicating including the capability of duplicating each dot line such that a number of times of duplication can be different for each dot line; and adding a dot line generated by duplication of said each dot line between an original dot line before having been duplicated and a following dot line in said elongation direction adjacent to said original dot line;

wherein the elongation data includes an equation for calculating a number of times of duplication to be carried out, in which each dot line is, represented by a line number and the number of times of duplication of the dot line represented by an arbitrary line number is represented as a function having the arbitrary line number as a parameter.

* * * * *